US009604462B2

(12) United States Patent
Chen et al.

(10) Patent No.: US 9,604,462 B2
(45) Date of Patent: Mar. 28, 2017

(54) PRINTING FLUID RESTRICTOR PLATE FOR AN INK JET PRINT HEAD ASSEMBLY AND METHOD

(71) Applicant: Illinois Tool Works Inc., Glenview, IL (US)

(72) Inventors: Tzer-Yi Chen, Brookfield, CT (US); Mustafa Turan, Brookfield, CT (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/860,212

(22) Filed: Sep. 21, 2015

(65) Prior Publication Data

US 2016/0009095 A1 Jan. 14, 2016

Related U.S. Application Data

(62) Division of application No. 14/514,051, filed on Oct. 14, 2014, now abandoned.

(60) Provisional application No. 61/911,271, filed on Dec. 3, 2013.

(51) Int. Cl.

| | |
|---|---|
| ***B41J 2/175*** | (2006.01) |
| ***B41J 2/055*** | (2006.01) |
| ***B41J 2/14*** | (2006.01) |

(52) U.S. Cl.

CPC ..... *B41J 2/175* (2013.01); *B41J 2/055* (2013.01); *B41J 2/14* (2013.01); *B41J 2/1433* (2013.01); *B41J 2202/11* (2013.01)

(58) Field of Classification Search

CPC ..... B41J 2/1631; B41J 2/14145; B41J 2002/14306; B41J 2/055; B41J 2/175; B41J 2202/11

See application file for complete search history.

(56) References Cited

U.S. PATENT DOCUMENTS 7,802,874 B2 * 9/2010 Wee ..... B41J 2/055 347/65

* cited by examiner

*Primary Examiner* — Geoffrey Mruk

(74) *Attorney, Agent, or Firm* — Christopher R. Carroll; The Small Patent Law Group LLC.

(57) ABSTRACT

A restrictor plate for an ink jet print head assembly includes a substantially flat body having fluid flow passageways extending through the body. The fluid flow passageways are elongated between a fluid receiving volume end and an opposite fluid ejection volume end. The receiving volume end is fluidly coupled with a chamber and the ejection volume end is fluidly coupled with an orifice of the assembly from which the fluid is ejected. The receiving volume end receives the ink from the chamber so that the ink flows through the passageways along a printing direction. The body is shaped around the one or more fluid flow passageways to form one or more bottlenecks in the one or more fluid flow passageways that increase a fluid flow resistance of the fluid along a direction in the one or more fluid flow passageways that is opposite of the printing direction.

20 Claims, 5 Drawing Sheets

PRINTING FLUID RESTRICTOR PLATE FOR AN INK JET PRINT HEAD ASSEMBLY AND METHOD

CROSS-REFERENCE TO RELATED APPLICATION

This application is a divisional of U.S. patent application Ser. No. 14/514,051, which was filed on 14 Oct. 2014, and which claims priority to U.S. Provisional Application No. 61/911,271, which was filed on 3 Dec. 2013, the entire disclosures of which are incorporated herein by reference.

BACKGROUND

Embodiments of the inventive subject matter described herein relate to ink jet printing.

BRIEF DESCRIPTION

In one example of the inventive subject matter, a restrictor plate for an ink jet print head assembly includes a substantially flat body having one or more fluid flow passageways extending through the body. The one or more fluid flow passageways are elongated between a fluid receiving volume end and an opposite fluid ejection volume end. The fluid receiving volume end is configured to be fluidly coupled with a chamber holding a volume of ink in the ink jet print head assembly. The fluid ejection volume end is configured to be fluidly coupled with an orifice of the ink jet print head assembly from which the fluid is ejected to print the fluid onto an object. The fluid receiving volume end of the one or more fluid flow passageways is configured to receive the volume of ink from the chamber so that the ink flows through the one or more fluid flow passageways to the fluid ejection volume end of the one or more fluid flow passageways along a printing direction to be ejected from the orifice of the ink jet print head assembly and printed onto the object. The body is shaped around the one or more fluid flow passageways to form one or more bottlenecks in the one or more fluid flow passageways that increase a fluid flow resistance of the fluid along a direction in the one or more fluid flow passageways that is opposite of the printing direction.

In another example of the inventive subject matter, an ink jet print head assembly includes a mechanical segment having a carrier body and plural pistons, and a fluidic segment having a printing plate assembly formed from plural plates coupled together. The plates includes a diaphragm plate configured to be struck by the pistons when the pistons are actuated, a spacer plate configured to form at least a portion of a chamber configured to hold a volume of fluid beneath where the diaphragm plate is struck by the pistons, a restrictor plate, and an orifice plate having one or more orifices through which the fluid is expelled to print the fluid onto an object. The restrictor plate includes one or more fluid flow passageways configured to fluidly couple the chamber with the one or more orifices such that the fluid flows through the one or more fluid flow passageways along a printing direction toward the one or more orifices. The restrictor plate is shaped around the one or more fluid flow passageways to form one or more bottlenecks in the one or more fluid flow passageways that increase a fluid flow resistance of the fluid along a direction that is opposite of the printing direction.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
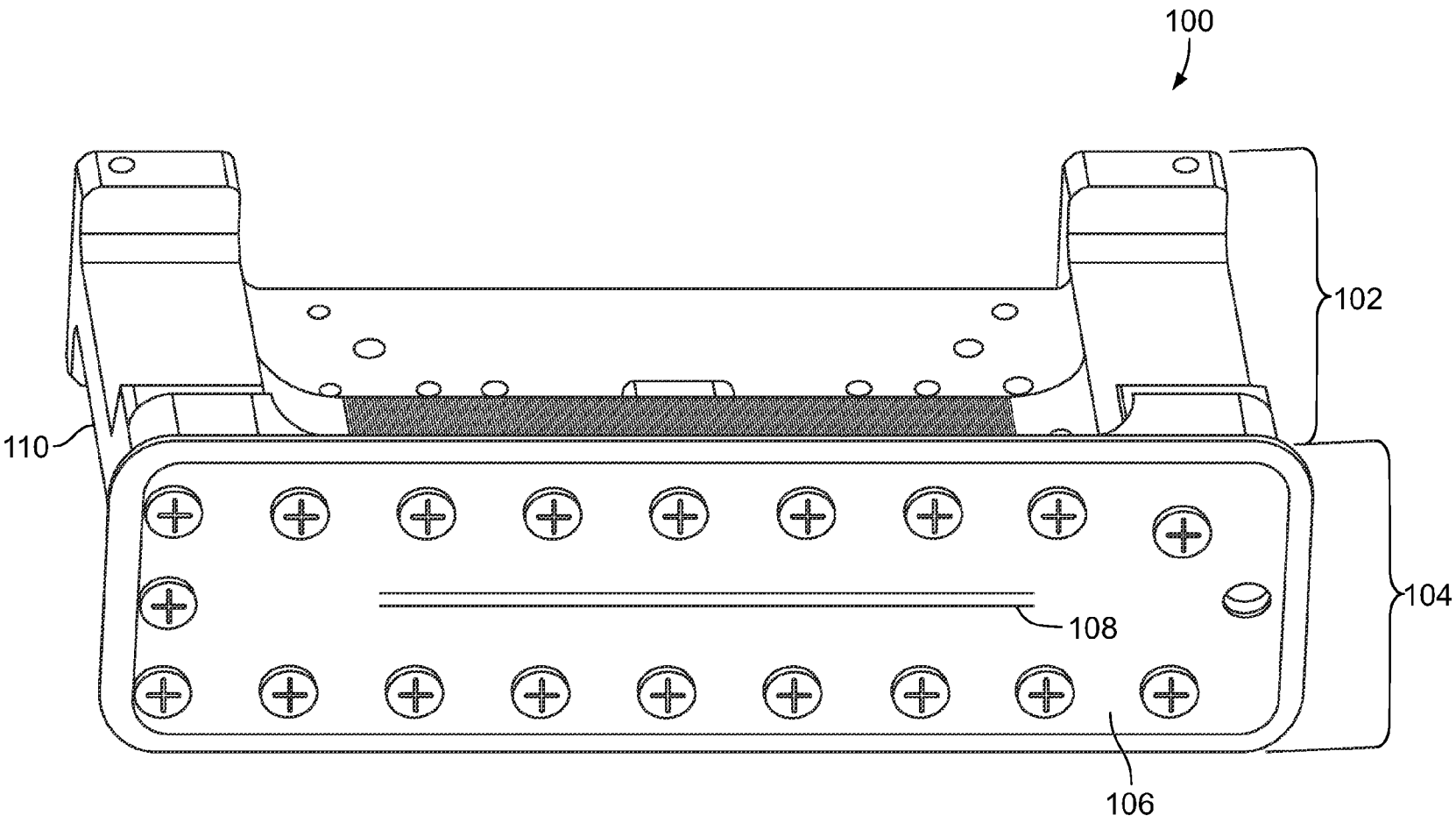
FIG. 1 is a perspective view of an ink jet print head assembly from a front or printing side in accordance with one embodiment.

FIG. 1 is a perspective view of an ink jet print head assembly 100 from a front or printing side in accordance with one embodiment. The assembly 100 can be used to print ink onto objects (such as packages, boxes, labels, and the like), goods (such as lumber, dry wall, and the like), or other items. As one example, the assembly 100 can print bar codes, labels, or other identifying indicia on objects. Additionally or alternatively, the assembly 100 can print chemicals used in the manufacture of various equipment (e.g., display devices, solar cells, ultraviolet thin films, coatings, or the like), such as by printing polyimides onto glass during the manufacture of display devices (e.g., Liquid Crystal Display screens). The assembly 100 includes a mechanical actuation segment 102 coupled with a fluidic segment 104. The mechanical actuation segment 102 includes various components that move in order to cause a fluid (e.g., an ink or other flowable matter) to be ejected from the assembly 100 and printed onto an object. The fluidic segment 104 includes various components that direct the internal flow of the fluid in the assembly 100 so that the movement occurring in the mechanical actuation segment 102 causes the fluid to be ejected from the assembly 100.

The mechanical actuation segment 102 includes a carrier body 110 that supports various components of the assembly 100. The carrier body 110 is connected with a printing plate assembly 106 of the fluidic segment 104. The printing plate assembly 106 controls the flow of the fluid inside the assembly 100 and from which the fluid is ejected from the assembly 100. The printing plate assembly 106 includes several printing holes or orifices 108 from which the fluid is ejected from the assembly 100.

Figure 2:
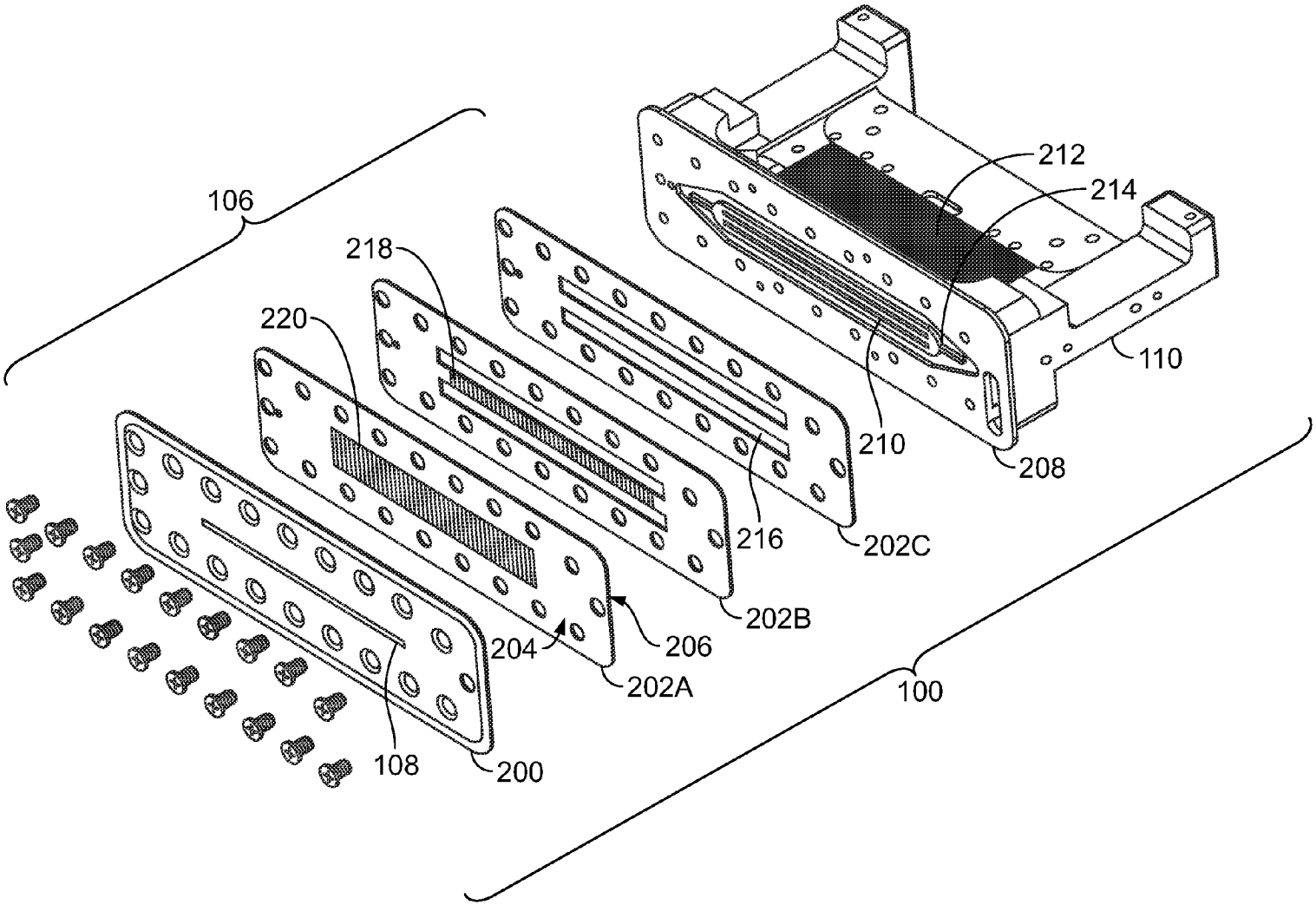
FIG. 2 is an exploded view of the ink jet print head assembly shown in FIG. 1.

FIG. 2 is an exploded view of the assembly 100 shown in FIG. 1. The carrier body 110 includes an ejection side 208 that faces the same direction in which fluid is ejected from the assembly 100. Several openings 210 extend through the ejection side 208 of the carrier body 106. These openings 210 are aligned with several pistons 212 connected with the carrier body 110. The pistons 212 are actuated to move toward or away from the ejection side 208 of the carrier body 110. As described below, different pistons 212 are aligned with different openings 210 so that the pistons 212 can be actuated to move in or out of the openings 210 toward the plate assembly 106. As the pistons 212 move into the openings 210, the pistons 212 strike a portion of the plate assembly 106 and cause ink to be ejected from one or more of the openings 108 in the plate assembly 106 toward the object to be printed upon.

The carrier body 110 includes a channel or manifold 214 that is recessed into the ejection side 208 of the carrier body 110. The channel or manifold 214 provides a space that holds the fluid to be ejected from the assembly 100. In the illustrated embodiment, the channel or manifold 214 extends around or encircles the openings 210 so that the fluid extends around the openings 210 prior to being ejected from the assembly 100.

The plate assembly 106 is formed from several plates 200, 202 (e.g., 200 202A-C) that are coupled together. A diaphragm plate 202C of the plate assembly 106 is disposed closest to and/or coupled with the ejection side 208 of the carrier body 110 in the illustrated embodiment. The diaphragm plate 202C separates the ends of the pistons 212 from chambers (shown below) that hold the fluid, as described below. The diaphragm plate 202C is struck by the pistons 212 when the pistons 212 move toward the diaphragm plate 202C. The striking of the diaphragm plate 202C by one or more of the pistons 212 causes the chambers aligned with these pistons 212 on the opposite side of the diaphragm plate 202C to be compressed. For example, the diaphragm plate 202C may define a portion (e.g., an upper wall) of the chambers that hold the fluid in the plate assembly 106. The compression of the diaphragm plate 202C above one or more of these chambers causes the fluid in the chambers to exit the chambers and be printed onto an object via the orifices 108 that are aligned with the chambers being compressed.

In the illustrated embodiment, the diaphragm plate 202C includes fluid passageways 216 that permit the fluid in the manifold or channel 214 to pass through the diaphragm plate 202C. The portion of the diaphragm plate 202C that is between these passageways 216 may be the portion that is struck by the pistons 212 to cause ejection of the fluid from the chambers. The diaphragm plate 202C separates the pistons 212 from the fluid such that the fluid does not contact the pistons 212.

A spacer plate 202B is coupled with the diaphragm plate 202C so that the diaphragm plate 202C is between the spacer plate 202B and the carrier body 110. The spacer plate 202B includes several openings 218 that are linearly aligned with the directions in which the pistons 212 are actuated to cause fluid to be ejected from the printing plate assembly 106. The portions of the spacer plate 202B around these openings 218 also can define boundaries of the various chambers in the printing plate 106. For example, the diaphragm plate 202C can define a top side of an approximately box-shaped chamber, and the portions of the spacer plate 202B that encircle the openings 218 can define the sides or side walls of the chambers that are generally oriented perpendicular to the diaphragm plate 202C. By way of analogy with the chambers being rooms, in one embodiment, the diaphragm plate 202C can serve as the ceiling of the room (e.g., chamber), while the portions of the spacer plate 202B that extend around the openings 218 represent the walls of the room (e.g., chamber).

A restrictor plate 202A is coupled with the spacer plate 202B so that the spacer plate 202B is between the restrictor plate 202A and the diaphragm plate 202C. The restrictor plate 202A includes a substantially or predominantly flat or planar body 220 having transversely oriented fluid flow passageways 220 cut through the entire thickness of the body 220. The body 220 may be formed from a conductive material, such as a metal or metal alloy (e.g., stainless steel). Optionally, the body 220 may be formed from a nonconductive material, such as a polymer. The passageways 220 are fluidly coupled with the chambers defined by the diaphragm plate 202C and the spacer plate 202B. These flow passageways 220 are elongated along directions that are parallel to or substantially parallel to the surfaces of the plates 200, 202 and that are perpendicular to or substantially perpendicular to the directions in which the fluid is ejected from the printing assembly 106. The flow passageways 220 are openings through the restrictor plate 202A that are separate from each other but that are at least partially aligned with the chambers such that, when a chamber is compressed by a piston 212, the fluid in the chamber is forced from the chamber and exits the chamber through the flow passageway 220 that is aligned with the chamber. The fluid is directed by the flow passageway 220 to one or more of the orifices 108 that are fluidly coupled with the flow passageway 220. The fluid is then ejected from the orifices 108.

When the pistons 212 move away from the diaphragm plate 202C after striking one or more of the chambers in the plate assembly 106, a partial vacuum or suction may be formed from the compression of the diaphragm plate 202C into the chamber. This partial vacuum or suction can pull or draw at least some of the fluid in the printing plate assembly 106 away from the orifices 108 and back toward the chambers in a direction that is opposite of the direction in which the fluid is pushed or otherwise forced when the piston 212 strikes the diaphragm plate 202C. This reverse movement of the fluid can lead to clogging of one or more openings or paths through which the fluid flows in the plate assembly 106.

In one embodiment, the restrictor plate 202A may be shaped around the flow passageways 220 such that the restrictor plate 202A encourages the flow of the fluid from the chambers toward the orifices 108, but restricts the flow of the fluid in the opposite direction. For example, it may be more difficult for fluid to flow within the flow passageways 220 in the restrictor plate 202A in directions from the orifices 108 to the chambers than in an opposite direction. The restrictor plate 202A may provide for a decreased fluid flow resistance in one direction (e.g., the direction in which the fluid flows in the restrictor plate 220A for printing) and an increased fluid flow resistance in an opposite direction. The fluid flow resistance may be a characteristic of how easily the fluid may flow in one or more directions. For example, lower fluid flow resistances indicate that a fluid may flow more easily (e.g., with less pressure applied to the fluid) in one direction relative to larger fluid flow resistances. In one aspect, a fluid flow resistance of a pathway (e.g., the fluid flow passageways defined by the restrictor plate 202A) may be defined as:

$$R_F = \frac{\Delta_P}{Q_V}$$

where $R_F$ represents the fluid flow resistance of the passageway, Δp represents the pressure drop in the fluid flowing in the passageway between two locations (e.g., a starting or upstream location, and an ending or downstream location), and $Q_V$ represents the rate at which the fluid is flowing between the two locations (e.g., a flow rate of the fluid). The flow rate may be defined as:

$$Q_V = \frac{Q}{t}$$

where Q represents a volume or other quantity of the fluid that is moving through or past a designated location (e.g., between the starting and ending locations) and t represents the time over which the fluid is moving through or past the designated location. Alternatively, the fluid flow resistance and/or flow rate may be defined in another manner which indicates the ease or difficulty in which the fluid may move in a passageway defined by the restrictor plate 202A.

A chamber or orifice plate 200 is coupled with the restrictor plate 202A so that the restrictor plate 202A is between the spacer plate 202B and the chamber or orifice plate 200. The plate 200 includes the orifices 108 that are fluidly coupled with the chambers by the flow passageways 220 in the restrictor plate 202A. As described above, when a piston 212 strikes the diaphragm plate 202C above a chamber, the chamber is compressed and the fluid in the compressed chamber flows into the orifice plate 200 via the flow passageway 220 in the restrictor plate 202A that is fluidly coupled with the chamber, and out of the assembly 100 via the orifice 108 that is fluidly coupled with the flow passageway 220.

Figure 3:
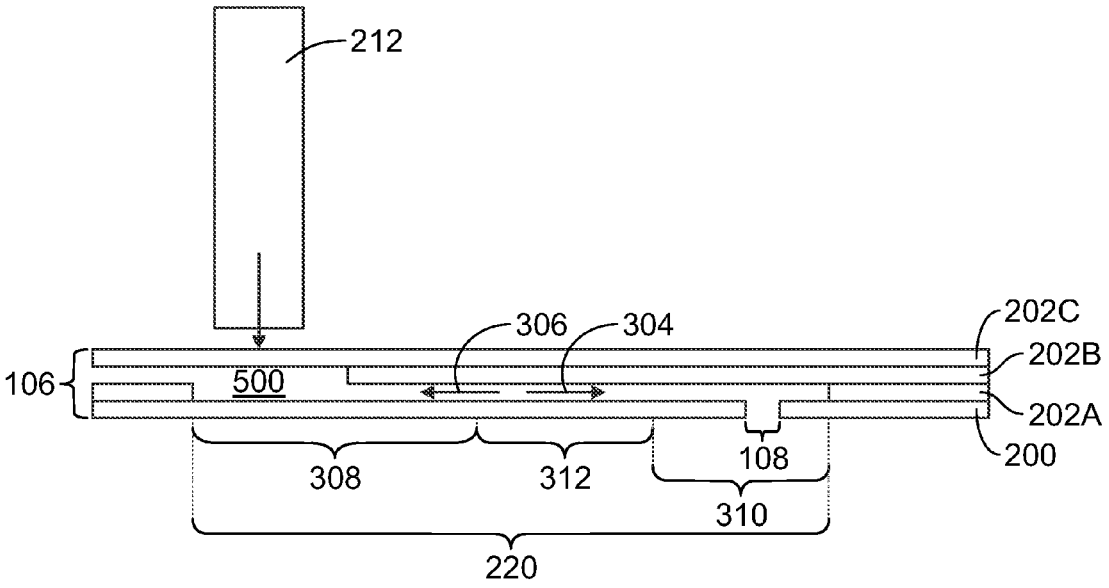
FIG. 3 is a schematic diagram of operation of a printing plate assembly shown in FIG. 1.

FIG. 3 is a schematic diagram of operation of the printing plate assembly 106. The illustration of the assembly 106 in FIG. 3 is not to scale, and is provided to demonstrate how the pistons 212 operate to force fluid out of chambers in the assembly 106 and out of the orifices 108.

The piston 212 moves in an actuation direction 502 in order to strike the portion of the diaphragm plate 202C that is above a chamber 500. As described above, this chamber 500 holds a volume of fluid to be printed by the assembly 100 (shown in FIG. 1), and is at least partially bounded by the diaphragm plate 202C, the spacer plate 202B, the restrictor plate 202A, and the orifice plate 200. The piston 212 strikes the diaphragm plate 202C and at least partially compresses the chamber 500. The compression of the chamber 500 increases the pressure in the fluid and forces the fluid into the flow passageway 220 of the restrictor plate 202A. The fluid may be received into a fluid receiving volume or volume end 308, which represents a subsection of the volume that is defined by the flow passageway 220. The fluid can flow through the receiving volume or volume end 308, through a flow restriction volume 312 of the flow passageway 220, and into a fluid ejection volume or volume end 310 of the flow passageway 220. The ejection volume 310 can be fluidly coupled with the orifice 108 in the orifice plate 200 so that the fluid flows through the flow passageway 220, into the orifice 108, and out of the assembly 106 via the orifice 108.

As described below, the flow passageways 220 in the restrictor plate 202A can have a variety of shapes and/or sizes in order to restrict or prevent the flow of fluid in one direction while allowing the flow of fluid in an opposite direction. For example, the restriction volume 312 of the flow passageway 220 can have a reduced fluid flow resistance in directions extending from the receiving volume 308 to the ejection volume 310 of the flow passageway 220 and an increased fluid flow resistance in opposite directions extending from the ejection volume 310 to the receiving volume 308. As a result, the fluid can more easily flow toward through the flow passageway 220 to the orifice 108 and can be prevented or significantly inhibited from flowing in an opposite direction.

While each of the restrictor plates shown in the Figures has the same shape and size of flow passageways 220 that differs from the flow passageways of one or more other restrictor plates, not all embodiments of the inventive subject matter are limited in this manner. For example, the flow passageways 220 may have another shape that is not illustrated but that provides for a reduced fluid flow resistance in one direction and an increased fluid flow resistance in an opposite direction. Additionally or alternatively, the restrictor plate may include a combination of two or more (or all) of the different flow passageways 220 shown or described herein.

Figure 4:
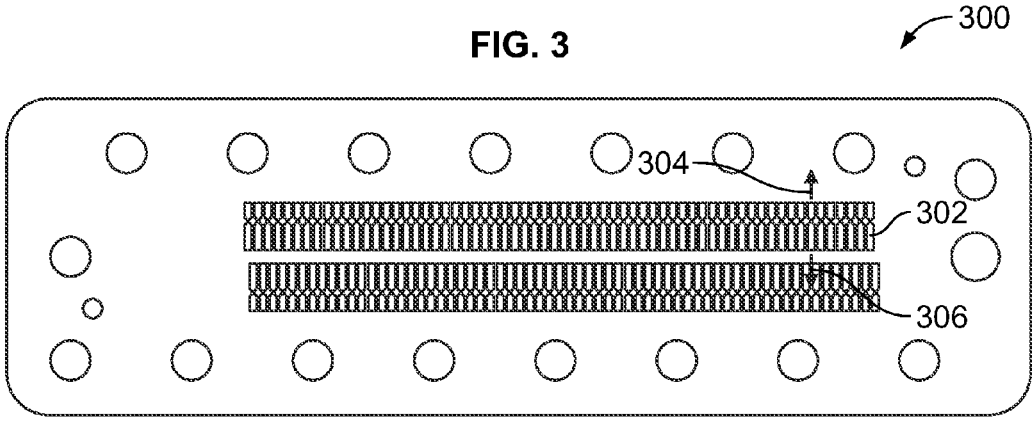
FIG. 4 illustrates a top view of a restrictor plate in accordance with one example.

FIG. 4 illustrates a top view of a restrictor plate 300 in accordance with one example. The restrictor plate 300 may represent the same restrictor plate 202A that is shown in FIG. 2. The restrictor plate 300 includes an array of flow passageways 302 that may be the same flow passageways 220 show in FIG. 2. The flow passageways 302 are elongated along opposite directions, such as the printing flow direction 304 and an opposite flow direction 306. The printing flow direction 304 for each flow passageway 302 represents the direction in which fluid flows when a piston 212 (shown in FIG. 2) compresses the chamber that is fluidly coupled with the flow passageway 302 to cause the fluid to be ejected from the assembly 100 (shown in FIG. 1) during printing. The opposite flow direction 306 represents the opposite direction (e.g., the direction in which the restrictor plate 300 has increased fluid flow resistance to reduce the rate at which the fluid flows).

Figure 5:
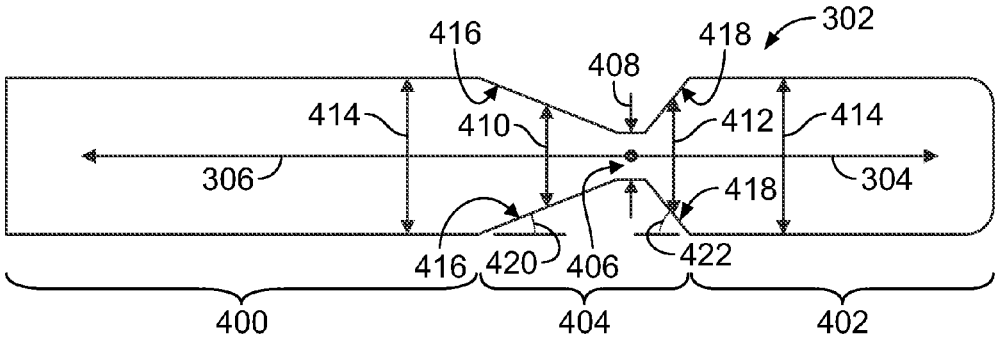
FIG. 5 is a top view of one of flow passageways in the restrictor plate shown in FIG. 4.

FIG. 5 is a top view of one of the flow passageways 302 in the restrictor plate 300 shown in FIG. 4. The flow passageway 302 defines plural interior volumes, including a fluid receiving volume 400 and a fluid ejection volume 402, which can represent the receiving volume 308 and the ejection volume 310 shown in FIG. 3, respectively. The receiving volume 400 represents the interior volume of the flow passageway 302 into which the fluid is forced when a piston 212 (shown in FIG. 2) compresses a chamber that is fluidly coupled with the flow passageway 302. The ejection volume 402 represents the interior volume of the flow passageway 302 from which the fluid flows to the orifice 108 (shown in FIG. 1). that is fluidly coupled with the flow passageway 302 during printing. The receiving volume 400 is fluidly coupled with the chamber while the ejection volume 402 is fluidly coupled with the orifice 108. As shown in FIG. 4, the interior volumes 400, 402 are separated from each other by an interior flow restriction volume 404 of the flow passageway 302, which can represent the restriction volume 312 shown in FIG. 3. The restriction volume 404 fluidly couples the interior volumes 400, 402 such that the fluid flows from the receiving volume 400 to the ejection volume 402 through the restriction volume 404.

The shape of the restrictor plate 302 around the interior volumes 400, 402, 404 restricts the flow of the fluid in the passageway 302 such that the fluid flow resistance of the passageway 302 in a direction from the receiving volume 400, through the restriction volume 404, and to the ejection volume 402 is less than the fluid flow resistance in the opposite direction from the ejection volume 402 to the receiving volume 400. For example, the fluid may flow through the volumes 400, 402, 404 in the printing direction 304 more easily than in the opposite direction 306 when an equal amount of pressure is applied to move the fluid in the respective directions.

In the illustrated example, the restrictor plate 300 increases the fluid flow resistance in the opposite direction 306 due to the shape of the restrictor plate 300 around the restriction volume 404. As shown in FIG. 4, the restrictor plate 300 defines a reduced volume bottleneck 406 within the restriction volume 404. This bottleneck 406 defines a smaller volume for the fluid to flow through relative to the other portions of the passageway 302. A width dimension 408 of the bottleneck 406 of the restrictor plate 300 is smaller than width dimensions 410, 412, 414 of the portions of the passageway 302 that are on opposite sides of the bottleneck 406. This reduced width dimension 408 restricts flow of the fluid through the restriction volume 404 as less fluid can get through the bottleneck 406 relative to other portions of the passageway 302 when pressure is applied to the fluid.

The restrictor plate 300 also can increase the fluid flow resistance in the opposite direction 306 due to the angles of sidewalls 416, 418 of the restrictor plate 300 on opposite sides of the bottleneck 406 inside the restriction volume 404. As shown in FIG. 4, the sidewalls 416 of the restrictor plate 300 define opposing boundaries of the passageway 302 that extend from the receiving volume 400 to the bottleneck 406 and the sidewalls 418 of the restrictor plate 300 define opposing boundaries of the passageway 302 that extend from the ejection volume 402 to the bottleneck 406. The sidewalls 416 between the receiving volume 400 and the bottleneck 406 are oriented at acute angles 420 relative to the directions 304, 306 while the sidewalls 418 between the ejection volume 402 and the bottleneck 406 are oriented at acute angles 422 relative to the directions 304, 306. As shown in FIG. 4, the acute angles 420, 422 are measured between the sidewalls 416, 418 and directions that are parallel to the directions 304, 306.

The acute angles 420 of the sidewalls 416 are smaller than the acute angles 422 of the sidewalls 418 in order to reduce the fluid flow resistance of the passageway 302 in the printing direction 304 and the acute angles 422 of the sidewalls 418 are larger than the angels 420 of the sidewalls 416 in order to increase the fluid flow resistance of the passageway 302 in the opposite direction 306. The smaller angles 420 of the sidewalls 416 can provide for reduced drag on the fluid as the fluid is forced in the printing direction 304. Conversely, the larger angles 422 of the sidewalls 418 can provide for increased drag on the fluid when any force is applied on the fluid to attempt to draw the fluid in the opposite direction 306. As a result, the fluid flow resistance of the passageway 302 is larger in the opposite direction 306 than in the printing direction 304.

Figure 6:
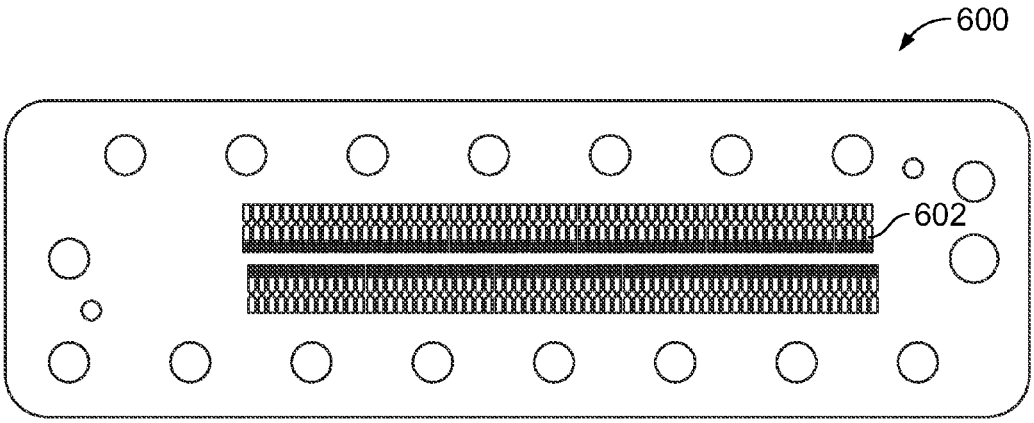
FIG. 6 illustrates a top view of a restrictor plate in accordance with one example.

FIG. 6 illustrates a top view of a restrictor plate 600 in accordance with one example. The restrictor plate 600 may represent the same restrictor plate 202A that is shown in FIG. 2. The restrictor plate 600 includes an array of flow passageways 602 that may be the same flow passageways 220 show in FIG. 2.

Figure 7:
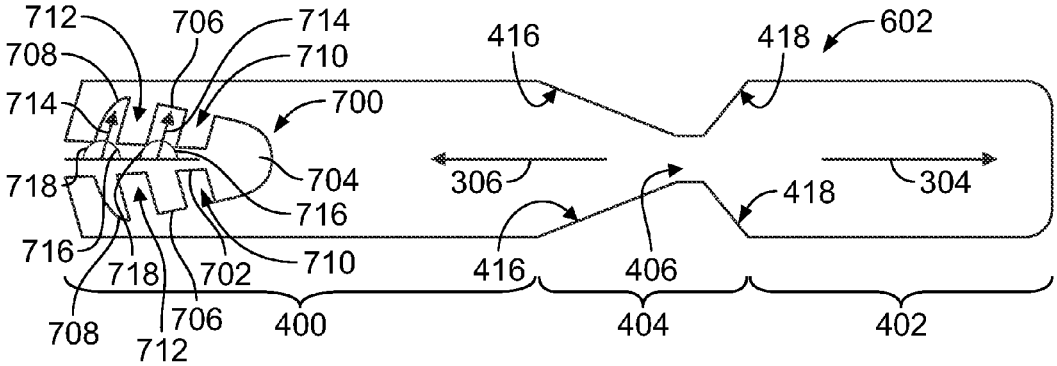
FIG. 7 is a top view of one of flow passageways in the restrictor plate shown in FIG. 6.

FIG. 7 is a top view of one of the flow passageways 602 in the restrictor plate 600 shown in FIG. 6. The flow passageways 602 are elongated along opposite directions, such as the printing flow direction 304 and an opposite flow direction 306 shown in FIGS. 3 through 5. The flow passageway 602 defines plural interior volumes, including the fluid receiving volume 400, the restriction volume 404, and the fluid ejection volume 402, which can represent the receiving volume 308, the restriction volume 312, and the ejection volume 310 shown in FIG. 3. As described above, the shape of the restrictor plate 602 around the interior volumes 400, 402, 404 restricts the flow of the fluid in the passageway 602 such that the fluid flow resistance of the passageway 602 in a direction from the receiving volume 400, through the restriction volume 404, and to the ejection volume 402 is less than the fluid flow resistance in the opposite direction from the ejection volume 402 to the receiving volume 400. The restrictor plate 600 increases the fluid flow resistance in the opposite direction 306 due to the shape of the restrictor plate 600 around the restriction volume 404. The restrictor plate 600 includes the reduced volume bottleneck 406 within the restriction volume 404, similar to as described above. The bottleneck 406 defines a smaller volume for the fluid to flow through relative to the other portions of the passageway 602. The restrictor plate 600 also can increase the fluid flow resistance in the opposite direction 306 due to the angles of the sidewalls 416, 418 of the restrictor plate 600 on opposite sides of the bottleneck 406 inside the restriction volume 404, similar to as descried above.

Additionally, the restrictor plate 600 includes a flow restriction protrusion 700 that extends into the receiving volume 400 of the passageway 602. The protrusion 700 includes part of the body of the restrictor plate 600 that is elongated and extends into the receiving volume 400 along the printing direction 304. In the illustrated example, the protrusion 700 includes an elongated spinal segment 702 that terminates at a rounded nub body 704. The spinal segment 702 includes several elongated arm segments 706, 708 that extend in opposite directions from the spinal segment 702. The arm segments 706, 708 on each side of the spinal segment 702 are spaced apart from each other along the printing and opposite directions 304, 406 by separation gaps 710, 712. Optionally, a larger or lesser number of arm segments and/or separation gaps may be provided.

The arm segments 706, 708 are oriented at acute angles with respect to the printing direction 304 and at obtuse angles with respect to the opposite direction 306 in the illustrated example. For example, directions 714 along which the arm segments 706, 708 are elongated from the spinal segment 702 are separated from the printing direction 304 by angles 716 that are less than ninety degrees. The directions 714 along which the arm segments 706, 708 are elongated from the spinal segment 702 are separated from the opposite direction 306 by angles 718 that are greater than ninety degrees. Optionally, the arm segments 706, 708 may be oriented at other angles with respect to the printing and/or opposite directions 304, 306.

The restriction protrusion 700 also increases the flow resistance along the opposite direction 306 relative to the flow resistance along the printing direction 304. For example, the angles 716, 718 at which the arm segments 706, 708 are oriented toward the printing direction 304 and away from the opposite direction 306, along with the separation gaps 710, 712 between the arm segments 706, 708, can increase the drag on movement of the fluid in the opposite direction 306 relative to flow of the fluid in the printing direction 304. The arm segments 706, 708 can resist the flow of the fluid in the opposite direction 306 such that the fluid may more easily flow in the printing direction 304. As a result, the fluid flow resistance may be larger along the opposite direction 306 than in the printing direction 304.

Figure 8:
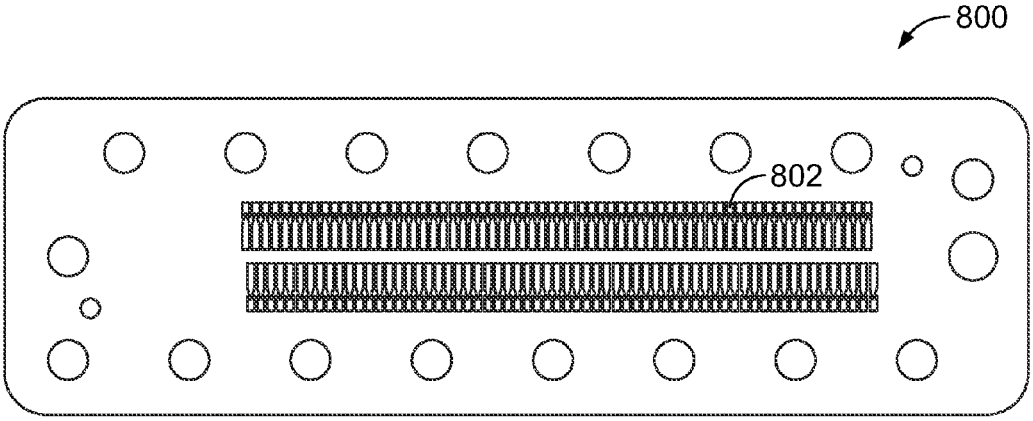
FIG. 8 illustrates a top view of a restrictor plate in accordance with one example.

FIG. 8 illustrates a top view of a restrictor plate 800 in accordance with one example. The restrictor plate 800 may represent the same restrictor plate 202A that is shown in FIG. 2. The restrictor plate 800 includes an array of flow passageways 802 that may be the same flow passageways 220 show in FIG. 2.

Figure 9:
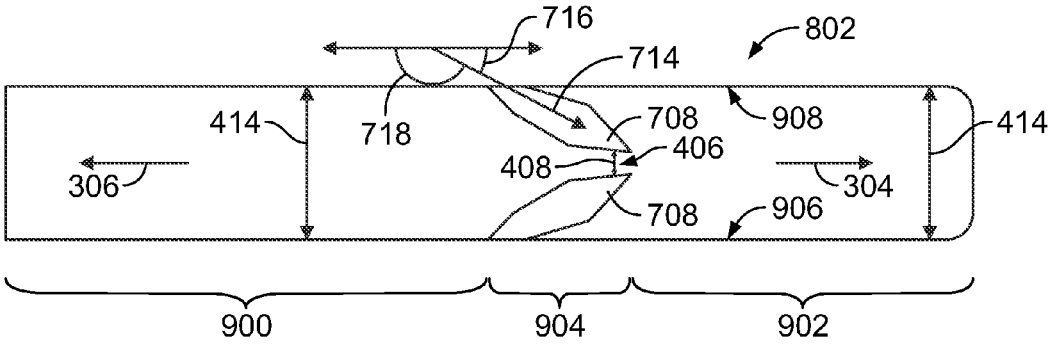
FIG. 9 is a top view of one of flow passageways in the restrictor plate shown in FIG. 8.

FIG. 9 is a top view of one of the flow passageways 802 in the restrictor plate 800 shown in FIG. 8. The flow passageways 802 are elongated along the printing flow direction 304 and the opposite flow direction 306. The flow passageway 802 defines plural interior volumes, including a fluid receiving volume 900 that receives the fluid from the chamber 500 (shown in FIG. 5), similar to the other receiving volumes described herein. The flow passageway 802 also includes a restriction volume 904 that restricts flow of the fluid in the opposite direction 306, similar to the other restriction volumes described herein. The flow passageway 802 also includes a fluid ejection volume 902 from which the fluid flows into the orifice 108 (shown in FIG. 1) for printing onto an object, similar to the other ejection volumes described herein. The volumes 900, 904, 902 can represent the corresponding receiving volume 308, the restriction volume 312, and the ejection volume 310 shown in FIG. 3

The shape of the restrictor plate 800 around the interior volumes 900, 902, 904 restricts the flow of the fluid in the passageway 802 such that the fluid flow resistance of the passageway 802 in a direction from the receiving volume 900, through the restriction volume 904, and to the ejection volume 902 is less than the fluid flow resistance in the opposite direction from the ejection volume 902 to the receiving volume 900. The restrictor plate 800 increases the fluid flow resistance in the opposite direction 306 due to the shape of the restrictor plate 800 around the restriction volume 904. The restrictor plate 800 includes the reduced volume bottleneck 406 within the restriction volume 904, similar to as described above. The bottleneck 406 defines a smaller volume for the fluid to flow through relative to the other portions of the passageway 802. This smaller volume can help in increasing the fluid flow resistance of the fluid in the passageway 802 along the opposite direction 306.

Additionally, the restrictor plate 800 includes elongated arm segments 708 (similar or identical to those shown in FIG. 7) that extend from opposing side walls 906, 908 of the restrictor plate 800. Optionally, a larger or lesser number of arm segments may be provided. For example, several arm segments 708 may extend from each or one of the opposing side walls 906, 908 of the restrictor plate 800. The arm segments 708 are oriented at acute angles 716 with respect to the printing direction 304 and at obtuse angles 718 with respect to the opposite direction 306 in the illustrated example. For example, the directions 714 along which the arm segments 708 are elongated from the side walls 908 are separated from the printing direction 304 by the angles 716, which are less than ninety degrees. The directions 714 along which the arm segments 708 are elongated from the side walls 908 are separated from the opposite direction 306 by the angles 718, which are greater than ninety degrees. Optionally, the arm segments 708 may be oriented at other angles with respect to the printing and/or opposite directions 304, 306.

The angles 716, 718 at which the arm segments 708 are oriented toward the printing direction 304 and away from the opposite direction 306 can increase the drag on movement of the fluid in the opposite direction 306 relative to flow of the fluid in the printing direction 304. The arm segments 708 can resist the flow of the fluid in the opposite direction 306 such that the fluid may more easily flow in the printing direction 304. As a result, the fluid flow resistance in the passageway 802 is greater in the opposite direction 306 than in the printing direction 304.

Figure 10:
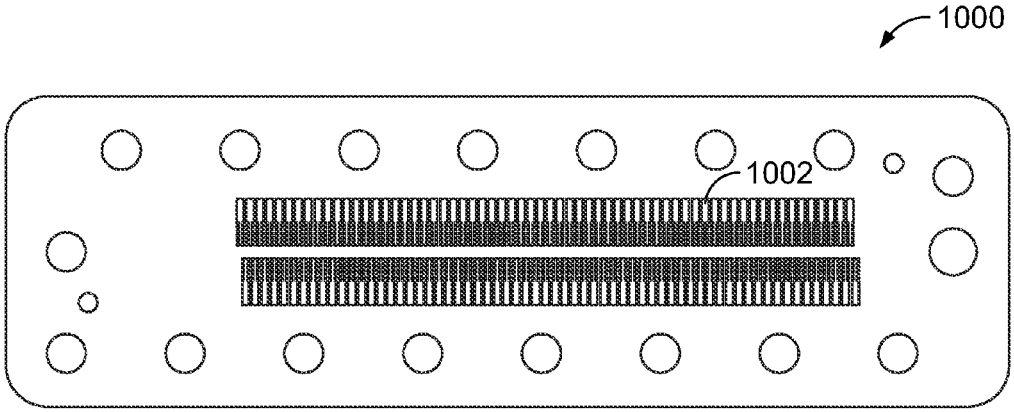
FIG. 10 illustrates a top view of a restrictor plate in accordance with one example.

FIG. 10 illustrates a top view of a restrictor plate 1000 in accordance with one example. The restrictor plate 1000 may represent the same restrictor plate 202A that is shown in FIG. 2. The restrictor plate 1000 includes an array of flow passageways 1002 that may be the same flow passageways 220 show in FIG. 2.

Figure 11:
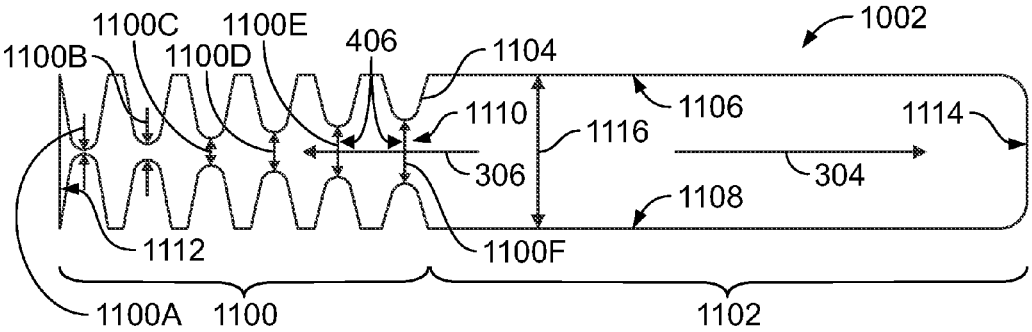
FIG. 11 is a top view of one of flow passageways in the restrictor plate shown in FIG. 10.

FIG. 11 is a top view of one of the flow passageways 1002 in the restrictor plate 1000 shown in FIG. 10. The flow passageways 1002 are elongated along the printing flow direction 304 and the opposite flow direction 306. The flow passageway 1002 defines plural interior volumes, including a hybrid fluid receiving and restricting volume 1100 and a fluid ejection volume 1102. The ejection volume 1102 may represent the ejection volume 310 shown in FIG. 3. The receiving and restricting volume 1100 may represent a combination of both the receiving volume 308 and the restricting volume 312 shown in FIG. 3. Optionally, the receiving and restricting volume 1100 may be separated into separate receiving and restricting volumes, similar to as described above. The receiving and restricting volume 1100 also may be referred to as a hybrid volume. For example, the hybrid volume 1100 may both receive the fluid from the chamber 500 (shown in FIG. 3), similar to as described above in connection with the other receiving volumes and increase the fluid flow resistance of the fluid in the opposite direction 306, similar to as described above in connection with the other restricting volumes.

The shape of the restrictor plate 1000 around and in the hybrid volume 1100 restricts the flow of the fluid in the passageway 1002 such that the fluid flow resistance of the passageway 1002 in a direction along the printing direction 304 is less than the fluid flow resistance in the opposite direction 306. The restrictor plate 1000 increases the fluid flow resistance in the opposite direction 306 due to the shape of the restrictor plate 1000 around and within the hybrid volume 1100.

For example, the restrictor plate 1000 includes arm segments 1104 that extend into the hybrid volume 1100 from opposing side walls 1106, 1108 of the restrictor plate 1000. The arm segments 1104 extend from the side walls 1106, 1108 in directions that are parallel or substantially parallel to opposing end walls 1112, 1114 of the passageway 1002. In the illustrated example, the arm segments 1104 are arranged in pairs, with each pair of arm segments 1104 including arm segments 1104 extending from the opposite side walls 1106, 1108, with each arm segment 1104 extending toward the arm segment 1104 protruding from the opposite side wall 1106 or 1108. Alternatively, the arm segments 1104 may not extend directly toward each other. Optionally, a larger or lesser number of arm segments may be provided.

The arm segments 1104 in the different pairs are separated by different width dimensions 1110 (e.g., width dimensions 1110A-F) that are measured in directions oriented perpendicular to the directions 304, 306. The arm segments 1104 located closer to one end wall 1112 (e.g., the end wall 1112 that is closer to the chamber 500 shown in FIG. 3 than the other end wall 1114) may be separated by a shorter width dimension 1110A than the arm segments 1104 located farther from the end wall 1112. As shown in FIG. 11, the width dimensions 1110 between the arm segments 1104 can increase for those pairs of the arm segments 1104 that are farther from the end wall 1112. The arm segments 1104 located farthest from the end wall 1112 may be separated by the largest width dimension 1110F in one embodiment. The width dimensions 1110 may be smaller than a width dimension 1116 between the opposing side walls 1106, 1108 in the ejection volume 1102.

The arm segments 1104 can increase the drag on movement of the fluid in the opposite direction 306 relative to flow of the fluid in the printing direction 304. The arm segments 1104 can resist the flow of the fluid in the opposite direction 306 such that the fluid may more easily flow in the printing direction 304. The different width dimensions 1110 between the arm segments 1104 can make it more difficult for the fluid to move in the direction 306 relative to the printing direction 304 because the volume in the passageway 1002 in which the fluid moves decreases as the fluid gets closer to the end wall 1112 than the opposite end wall 1114. For example, the arm segments 1104 that extend toward each other can form several bottlenecks 406, similar to as described above. These bottlenecks 406 can vary in size so that the fluid flow resistance along the direction 306 between the arm segments 1104 increases for those arm segments 1104 closer to the end wall 1112 than for those arm segments 1104 located farther from the end wall 1112. As a result, the fluid flow resistance in the passageway 1002 is greater in the opposite direction 306 than in the printing direction 304.

In one example of the inventive subject matter, a restrictor plate for an ink jet print head assembly includes a substantially flat body having one or more fluid flow passageways extending through the body. The one or more fluid flow passageways are elongated between a fluid receiving volume end and an opposite fluid ejection volume end. The fluid receiving volume end is configured to be fluidly coupled with a chamber holding a volume of ink in the ink jet print head assembly. The fluid ejection volume end is configured to be fluidly coupled with an orifice of the ink jet print head assembly from which the fluid is ejected to print the fluid onto an object. The fluid receiving volume end of the one or more fluid flow passageways is configured to receive the volume of ink from the chamber so that the ink flows through the one or more fluid flow passageways to the fluid ejection volume end of the one or more fluid flow passageways along a printing direction to be ejected from the orifice of the ink jet print head assembly and printed onto the object. The body is shaped around the one or more fluid flow passageways to form one or more bottlenecks in the one or more fluid flow passageways that increase a fluid flow resistance of the fluid along a direction in the one or more fluid flow passageways that is opposite of the printing direction.

In one aspect, the body is shaped to define a fluid flow restriction volume between the fluid receiving volume end and the fluid ejection volume end of the one or more fluid flow passageways. The one or more bottlenecks can be disposed within the fluid flow restriction volume.

In one aspect, the body includes opposing side walls that extend along opposite sides of the one or more fluid flow passageways. The side walls can be parallel or substantially parallel to the printing direction in at least one of the fluid receiving volume end or the fluid ejection volume end. The side walls can be transversely oriented at non-parallel angles with respect to the printing direction in the fluid flow restriction volume.

In one aspect, first portions of the side walls extending from the fluid receiving volume end toward the one or more bottlenecks are oriented at first angles with respect to the printing direction and second portions of the side walls extending from the fluid ejecting volume end toward the one or more bottlenecks are oriented at second angles with respect to the printing direction. The first angles can be smaller than the second angles.

In one aspect, the body includes a flow restriction protrusion extending into at least one of the one or more fluid flow passageways. The flow restriction protrusion also may increase the fluid flow resistance of the fluid along the direction that is opposite of the printing direction.

In one aspect, the flow restriction protrusion includes a spinal segment elongated along the printing direction and plural arm segments separated from each other and extending away from the spinal segment into the fluid flow passageway.

In one aspect, the plural arm segments are elongated away from the spinal segment in directions that are oriented at one or more acute angles with respect to the printing direction and at one or more oblique angles with respect to a direction that is opposite of the printing direction.

In one aspect, the body includes opposing side walls extending along opposite sides of the one or more fluid flow passageways and elongated arm segments protruding into the one or more fluid flow passageways from the side walls.

In one aspect, the arm segments are elongated along directions that are oriented at one or more acute angles with respect to the printing direction and at one or more oblique angles with respect to a direction that is opposite of the printing direction.

In one aspect, the arm segments are arranged in plural pairs of arms segments with the arm segments in each pair extending toward each other from the opposing side walls.

In one aspect, the arm segments in each pair are separated from each other by a width dimension. The width dimension can be larger for the pairs of the arm segments located closer to the fluid ejection volume end than for the pairs of the arm segments located farther from the fluid ejection volume end.

In one aspect, the arm segments in each pair are separated from each other by a width dimension. The width dimension can be smaller for the pairs of the arm segments located closer to the fluid ejection volume end than for the pairs of the arm segments located farther from the fluid ejection volume end.

In another example of the inventive subject matter, an ink jet print head assembly includes a mechanical segment having a carrier body and plural pistons, and a fluidic segment having a printing plate assembly formed from plural plates coupled together. The plates includes a diaphragm plate configured to be struck by the pistons when the pistons are actuated, a spacer plate configured to form at least a portion of a chamber configured to hold a volume of fluid beneath where the diaphragm plate is struck by the pistons, a restrictor plate, and an orifice plate having one or more orifices through which the fluid is expelled to print the fluid onto an object. The restrictor plate includes one or more fluid flow passageways configured to fluidly couple the chamber with the one or more orifices such that the fluid flows through the one or more fluid flow passageways along a printing direction toward the one or more orifices. The restrictor plate is shaped around the one or more fluid flow passageways to form one or more bottlenecks in the one or more fluid flow passageways that increase a fluid flow resistance of the fluid along a direction that is opposite of the printing direction.

In one aspect, the restrictor plate defines a fluid flow restriction volume in the one or more fluid flow passageways between the fluid receiving volume end and the fluid ejection volume end of the one or more fluid flow passageways. The one or more bottlenecks can be disposed within the fluid flow restriction volume.

In one aspect, the restrictor plate includes opposing side walls that extend along opposite sides of the one or more fluid flow passageways. The side walls can be parallel or substantially parallel to the printing direction in at least one of the fluid receiving volume end or the fluid ejection volume end, and the side walls are transversely oriented at non-parallel angles with respect to the printing direction in the fluid flow restriction volume.

In one aspect, first portions of the side walls extending from the fluid receiving volume end toward the one or more bottlenecks are oriented at first angles with respect to the printing direction and second portions of the side walls extending from the fluid ejecting volume end toward the one or more bottlenecks are oriented at second angles with respect to the printing direction. The first angles can be smaller than the second angles.

In one aspect, the restrictor plate includes a flow restriction protrusion extending into at least one of the one or more fluid flow passageways. The flow restriction protrusion also can increase the fluid flow resistance of the fluid along the direction that is opposite of the printing direction.

In one aspect, the flow restriction protrusion includes a spinal segment elongated along the printing direction and plural arm segments separated from each other and extending away from the spinal segment into the fluid flow passageway.

In one aspect, the plural arm segments are elongated away from the spinal segment in directions that are oriented at one or more acute angles with respect to the printing direction and at one or more oblique angles with respect to a direction that is opposite of the printing direction.

In one aspect, the restrictor plate includes opposing side walls extending along opposite sides of the one or more fluid flow passageways and elongated arm segments protruding into the one or more fluid flow passageways from the side walls.

In one aspect, the arm segments are elongated along directions that are oriented at one or more acute angles with respect to the printing direction and at one or more oblique angles with respect to a direction that is opposite of the printing direction.

In one aspect, the arm segments are arranged in plural pairs of arms segments with the arm segments in each pair extending toward each other from the opposing side walls.

In one aspect, the arm segments in each pair are separated from each other by a width dimension. The width dimension can be larger for the pairs of the arm segments located closer to the fluid ejection volume end than for the pairs of the arm segments located farther from the fluid ejection volume end.

In one aspect, the arm segments in each pair are separated from each other by a width dimension. The width dimension can be smaller for the pairs of the arm segments located closer to the fluid ejection volume end than for the pairs of the arm segments located farther from the fluid ejection volume end.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended clauses, along with the full scope of equivalents to which such clauses are entitled. In the appended clauses, the terms "including" and "in which" are used as the plain-English equivalents of the respective terms "comprising" and "wherein." Moreover, in the following clauses, the terms "first," "second," and "third," etc. are used merely as labels, and are not intended to impose numerical requirements on their objects. Further, the limitations of the following clauses are not written in means-plus-function format and are not intended to be interpreted based on 35 U.S.C. §112(f), unless and until such clause limitations expressly use the phrase "means for" followed by a statement of function void of further structure. For example, the recitation of a "mechanism for," "module for," "device for," "unit for," "component for," "element for," "member for," "apparatus for," "machine for," or "system for" is not to be interpreted as invoking 35 U.S.C. §112(f) and any claim that recites one or more of these terms is not to be interpreted as a means-plus-function claim.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the clauses, and may include other examples that occur to one of ordinary skill in the art. Such other examples are intended to be within the scope of the clauses if they have structural elements that do not differ from the literal language of the clauses, or if they include equivalent structural elements with insubstantial differences from the literal languages of the clauses.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A restrictor plate for an ink jet print head assembly, the restrictor plate comprising:

a substantially flat body having opposing side walls on opposite sides of a fluid flow passageway extending through the body, the fluid flow passageway elongated along a printing flow direction that is parallel to the side walls between a fluid receiving volume end and an opposite fluid ejection volume end, the fluid receiving volume end configured to be fluidly coupled with a chamber holding a volume of ink in the ink jet print head assembly, the fluid ejection volume end configured to be fluidly coupled with an orifice of the ink jet print head assembly, wherein the fluid flows through the fluid flow passageway in the printing flow direction to be ejected through the orifice to print the fluid onto an object, wherein the body is shaped around the fluid flow passageway to form one or more bottlenecks in the fluid flow passageway that increase a fluid flow resistance of the fluid along a direction in the fluid flow passageway that is opposite of the printing flow direction and that is parallel to the side walls, and wherein the body includes a flow restriction protrusion extending into the fluid flow passageway, the flow restriction protrusion extending into the fluid flow passageway from the fluid receiving volume end of the fluid flow passageway in the direction that is opposite of the printing flow direction, the flow restriction protrusion also increasing the fluid flow resistance of the fluid along the direction that is opposite of the printing direction.

2. The restrictor plate of claim 1, wherein the body is shaped to define a fluid flow restriction volume between the fluid receiving volume end and the fluid ejection volume end of the fluid flow passageway, and wherein the one or more bottlenecks are disposed within the fluid flow restriction volume.

3. The restrictor plate of claim 2, wherein the body includes opposing side walls that extend along opposite sides of the fluid flow passageway with the flow restriction protrusion extending into the fluid flow passageway between the side walls, and wherein the side walls are parallel or substantially parallel to the printing direction in at least one of the fluid receiving volume end or the fluid ejection volume end, and the side walls are transversely oriented at non-parallel angles with respect to the printing direction in the fluid flow restriction volume.

4. The restrictor plate of claim 3, wherein first portions of the side walls extending from the fluid receiving volume end toward the one or more bottlenecks are oriented at first angles with respect to the printing direction and second portions of the side walls extending from the fluid ejecting volume end toward the one or more bottlenecks are oriented at second angles with respect to the printing direction, the first angles being smaller than the second angles.

5. The restrictor plate of claim 4, wherein the flow restriction protrusion includes a spinal segment elongated along the direction that is opposite of the printing direction and plural arm segments separated from each other and extending away from the spinal segment into the fluid flow passageway.

6. The restrictor plate of claim 5, wherein the plural arm segments are elongated away from the spinal segment in directions that are oriented at one or more acute angles with respect to the printing direction and at one or more oblique angles with respect to the direction that is opposite of the printing direction.

7. The restrictor plate of claim 1, wherein the body includes opposing side walls extending along opposite sides of the fluid flow passageway and elongated arm segments protruding into the fluid flow passageway from the side walls.

8. The restrictor plate of claim 7, wherein the arm segments are elongated along directions that are oriented at one or more acute angles with respect to the printing direction and at one or more oblique angles with respect to a direction that is opposite of the printing direction.

9. The restrictor plate of claim 7, wherein the arm segments are arranged in plural pairs of arms segments with the aim segments in each pair extending toward each other from the opposing side walls.

10. The restrictor plate of claim 9, wherein the arm segments in each pair are separated from each other by a width dimension, the width dimension being larger for the pairs of the arm segments located closer to the fluid ejection volume end than for the pairs of the arm segments located farther from the fluid ejection volume end.

11. The restrictor plate of claim 9, wherein the arm segments in each pair are separated from each other by a width dimension, the width dimension being smaller for the pairs of the arm segments located closer to the fluid ejection volume end than for the pairs of the arm segments located farther from the fluid ejection volume end.

12. An ink jet print head assembly comprising:

a mechanical segment having a carrier body and plural pistons; and a fluidic segment having a printing plate assembly formed from plural plates coupled together, the plates including a diaphragm plate configured to be struck by the pistons when the pistons are actuated, a spacer plate configured to form at least a portion of a chamber configured to hold a volume of fluid beneath where the diaphragm plate is struck by the pistons, a restrictor plate, and an orifice plate having one or more orifices through which the fluid is expelled to print the fluid onto an object, wherein the restrictor plate includes opposing side walls on opposite sides of one or more fluid flow passageways configured to fluidly couple the chamber with the one or more orifices such that the fluid flows through the one or more fluid flow passageways along a printing direction that is parallel to the side walls and toward the one or more orifices, wherein the restrictor plate is shaped around the one or more fluid flow passageways to form one or more bottlenecks in the one or more fluid flow passageways that increase a fluid flow resistance of the fluid along a direction that is opposite of the printing direction and that is parallel to the side walls, and wherein the restrictor plate includes one or more flow restriction protrusions extending into at least one of the one or more fluid flow passageways from one end of the at least one of the one or more fluid flow passageways along the direction that is opposite of the printing direction, the one or more flow restriction protrusions also increasing the fluid flow resistance of the fluid along the direction that is opposite of the printing direction.

13. The ink jet print head assembly of claim 12, wherein the restrictor plate defines a fluid flow restriction volume in the one or more fluid flow passageways between the fluid receiving volume end and the fluid ejection volume end of the one or more fluid flow passageways, and wherein the one or more bottlenecks are disposed within the fluid flow restriction volume.

14. The ink jet print head assembly of claim 13, wherein the restrictor plate includes opposing side walls that extend along opposite sides of the one or more fluid flow passageways, and wherein the side walls are parallel or substantially parallel to the printing direction in at least one of the fluid receiving volume end or the fluid ejection volume end, and the side walls are transversely oriented at non-parallel angles with respect to the printing direction in the fluid flow restriction volume.

15. The ink jet print head assembly of claim 14, wherein first portions of the side walls extending from the fluid receiving volume end toward the one or more bottlenecks are oriented at first angles with respect to the printing direction and second portions of the side walls extending from the fluid ejecting volume end toward the one or more bottlenecks are oriented at second angles with respect to the printing direction, the first angles being smaller than the second angles.

16. The ink jet print head assembly of claim 12, wherein the flow restriction protrusion includes a spinal segment elongated along the direction that is opposite of the printing direction and plural arm segments separated from each other and extending away from the spinal segment into the fluid flow passageway.

17. The ink jet print head assembly of claim 16, wherein the plural arm segments are elongated away from the spinal segment in directions that are oriented at one or more acute angles with respect to the printing direction and at one or more oblique angles with respect to the direction that is opposite of the printing direction.

18. The ink jet print head assembly of claim 12, wherein the restrictor plate includes opposing side walls extending along opposite sides of the one or more fluid flow passageways and elongated arm segments protruding into the one or more fluid flow passageways from the side walls.

19. The ink jet print head assembly of claim 18, wherein the arm segments are elongated along directions that are oriented at one or more acute angles with respect to the printing direction and at one or more oblique angles with respect to a direction that is opposite of the printing direction.

20. The ink jet print head assembly of claim 18, wherein the arm segments are arranged in plural pairs of arms segments with the arm segments in each pair extending toward each other from the opposing side walls.

* * * * *